US011613913B2

(12) United States Patent
Chen et al.

(10) Patent No.: US 11,613,913 B2
(45) Date of Patent: Mar. 28, 2023

(54) INTELLIGENT LOCK

(71) Applicants: Nuctech Company Limited, Beijing (CN); Tsinghua University, Beijing (CN)

(72) Inventors: Zhiqiang Chen, Beijing (CN); Yuanjing Li, Beijing (CN); Xianghao Wu, Beijing (CN); Shiguo Liu, Beijing (CN); Dawei Shi, Beijing (CN)

(73) Assignees: Nuctech Company Limited, Beijing (CN); Tsinghua University, Beijing (CN)

( * ) Notice: Subject to any disclaimer, the term of this patent is extended or adjusted under 35 U.S.C. 154(b) by 224 days.

(21) Appl. No.: 15/733,351

(22) PCT Filed: Jan. 13, 2020

(86) PCT No.: PCT/CN2020/071779

§ 371 (c)(1),
(2) Date: Jul. 8, 2020

(87) PCT Pub. No.: WO2020/228372

PCT Pub. Date: Nov. 19, 2020

(65) Prior Publication Data

US 2021/0222461 A1 Jul. 22, 2021

(30) Foreign Application Priority Data

May 14, 2019 (CN) ..... 201910401181.1

(51) Int. Cl.
*E05B 47/00* (2006.01)
*E05B 47/06* (2006.01)
*E05B 67/06* (2006.01)

(52) U.S. Cl.
CPC ..... *E05B 47/0603* (2013.01); *E05B 47/0001* (2013.01); *E05B 67/063* (2013.01); *E05Y 2900/604* (2013.01)

(58) Field of Classification Search
CPC .. E05B 47/00; E05B 47/0603; E05B 47/0001; E05B 67/063; E05Y 2900/604; Y10T 70/491

(Continued)

(56) References Cited

U.S. PATENT DOCUMENTS 6,360,571 B1 * 3/2002 O'Neal ..... B60R 25/09 70/53
6,401,501 B1 * 6/2002 Kajuch ..... E05B 67/22 63/38

(Continued)

FOREIGN PATENT DOCUMENTS

CN 201826644 U 5/2011
CN 204163497 U 2/2015

(Continued)

OTHER PUBLICATIONS

"International Application Serial No. PCT/CN2020/071779, International Search Report dated Apr. 14, 2020", (Apr. 14, 2020), 4 pgs.

(Continued)

*Primary Examiner* — Suzanne L Barrett

(74) *Attorney, Agent, or Firm* — Schwegman Lundberg & Woessner, P.A.

(57) ABSTRACT

The present disclosure provides an intelligent lock. In an embodiment, the intelligent lock includes: a lock body having a lock hole; a lock lever, the lock lever being capable of being plugged into and being unplugged out of the lock hole of the lock body; a first restricting member movably provided inside the lock body, and capable of being moved and latched into the lock hole to restrict the plugging of the lock lever into the lock hole or the unplugging of the lock lever out of the lock hole; a second restricting member movably provided inside the lock body, and capable of being abutted against the first restricting member so as to restrict a movement of the first restricting member; a detecting device provided in the lock body, and configured to detect the plugging operation of the lock lever into the lock hole or the unplugging operation of the lock lever out of the lock hole and to send a detection signal; and a main control element communicatively connected to the detecting device, and configured to determine a locking state of the intelligent (Continued)

lock in accordance with the detection signal sent by the detecting device.

9 Claims, 3 Drawing Sheets

(58) Field of Classification Search
USPC ..... 70/20–49, 53
See application file for complete search history.

(56) References Cited

U.S. PATENT DOCUMENTS

| | | | | |
|---|---|---|---|---|
| 7,685,851 | B2 * | 3/2010 | Lai | E05B 37/025 70/30 |
| 2006/0283216 | A1 * | 12/2006 | Marcelle | G07C 9/00182 70/38 A |
| 2008/0066502 | A1 * | 3/2008 | Sheehan | G01S 19/16 342/357.54 |
| 2009/0282876 | A1 * | 11/2009 | Zuraski | E05B 67/003 70/278.1 |
| 2010/0083713 | A1 * | 4/2010 | Woodling | E05B 67/22 70/22 |
| 2014/0157838 | A1 | 6/2014 | Nave | |

FOREIGN PATENT DOCUMENTS

| | | | |
|---|---|---|---|
| CN | 107956318 | A | 4/2018 |
| CN | 108131065 | A | 6/2018 |
| CN | 108549923 | A | 9/2018 |
| CN | 208669117 | U | 3/2019 |
| CN | 110107157 | A | 8/2019 |

OTHER PUBLICATIONS

"International Application Serial No. PCT/CN2020/071779, Written Opinion dated Apr. 14, 2020", (Apr. 14, 2020), 4 pgs.

* cited by examiner

INTELLIGENT LOCK

CROSS-REFERENCE TO RELATED APPLICATION

This application is a U.S. National. Stage Filing under 35 U.S.C. 371 from International Application No. PCT/CN2020/071779, filed on Jan. 13, 2020, and published as WO2020/228372 on 19 Nov. 2020, which claims priority to Chinese Patent Application No. 201910401181.1 filed on May 14, 2019 in the China. National Intellectual Property Administration; the benefit of priority of each of which is hereby claimed herein, and which applications and publication are hereby incorporated herein by reference in their entirety.

TECHNICAL FIELD

The present disclosure generally relates to the field of logistics supervision, and particularly, to an intelligent lock.

BACKGROUND

In the fields of logistics transportation or customs clearance inspection, it is necessary to prevent a cargo compartment (for example, a container) being transported or to be inspected from being opened illegally without permission, so as to ensure the safety of cargo compartment transportation and guarantee the supervisory role of customs clearance inspection, thereby not giving criminals an opportunity. Therefore, a lock used to lock the cargo compartment needs to have high safety and reliability. On the other hand, the lock also needs to be easy to operate and can be adapted to satisfy the locking requirements of cargo compartments with different types/sizes.

Traditional lock usually adopts a structure in which a lock body and a lock rope cooperate with each other. When locking, the lock rope is inserted into a lock hole of the lock body, and when unlocking, the lock rope is pulled out of the lock hole of the lock body. In traditional lock, the length of the lock rope is fixed and cannot be adjusted, and it cannot be applied to the locking requirements of cargo compartments with different types/sizes at the same time. Moreover, the cooperation between the lock rope and the lock body can only be achieved by unidirectional insertion and pulling-out operations, which limits the use flexibility of the lock.

In addition, some smart locks used to lock the cargo compartment adopt auxiliary devices such as travel switches or Hall devices to determine the position and/or travel of a lock tongue (or a lock lever) in the lock body (or the lock hole) to confirm unlocking/locking status of the lock. However, in practice, in the smart locks, auxiliary devices such as travel switches are relatively large and inconvenient to be installed. Moreover, it is sometimes easily affected adversely by the external environment and has a short service life.

SUMMARY

In order to solve or alleviate at least one of the above problems existing in the prior art, the present disclosure provides an intelligent lock.

According to an aspect of the present application, there is provided an intelligent lock comprising:

a lock body having a lock hole;

a lock lever, the lock lever being capable of being plugged into and being unplugged out of the lock hole of the lock body;

a first restricting member movably provided inside the lock body, and capable of being moved and latched into the lock hole to restrict the plugging of the lock lever into the lock hole or the unplugging of the lock lever out of the lock hole;

a second restricting member movably provided inside the lock body, and capable of being abutted against the first restricting member so as to restrict a movement of the first restricting member;

a detecting device provided in the lock body, and configured to detect the plugging operation of the lock lever into the lock hole or the unplugging operation of the lock lever out of the lock hole and to send a detection signal; and a main control element communicatively connected to the detecting device, and configured to determine a locking state of the intelligent lock in accordance with the detection signal sent by the detecting device.

In some embodiments, the second restricting member is movable inside the lock body, between a first position in which the second restricting member is abutted against the first restricting member and a second position in which the second restricting member is separated from the first restricting member; and the detecting device comprises: a first detecting element provided at the first position and a second detecting element provided at the second position; wherein, the main control element is configured: in response to the second restricting member being moved to be in contact with the first detecting element, to determine, in accordance with the detection signal sent by the first detecting element, that the intelligent lock is in an occluded state where the plugging of the lock lever into the lock hole or the unplugging of the lock lever out of the lock hole is defeated; and in response to the second restricting member being moved to be in contact with the second detecting element, to determine, in accordance with the detection signal sent by the second detecting element, that the intelligent lock is in an un-occluded state where the plugging of the lock lever into the lock hole or the unplugging of the lock lever out of the lock hole is freely enabled.

In some embodiments, the detecting device may further comprise: a third detecting element provided at a bottom of the lock hole; wherein, in response to the lock lever being plugged into the lock hole, the lock lever is in contact with the third detecting element, and the main control element determines that the lock lever is in a plugged state in accordance with the detection signal sent by the third detecting element.

In some embodiments, in the occluded state of the intelligent lock, the main control element determines that the intelligent lock is in an abnormal condition if no detection signal is sent by any one of the first detecting element and the third detecting element.

In some embodiments, the first detecting element, the second detecting element, and the third detecting element are spring-loaded post rods.

In some embodiments, the intelligent lock may further comprise: a driving element provided inside the lock body, and configured to drive a movement of the second restricting member inside the lock body, between the first position and the second position; wherein the driving element comprises: a driving motor; and a threaded rod configured to be driven by the driving motor, the threaded rod and the second restricting member constituting a threaded drive.

In some embodiments, the second restricting member has: a center part configured to be engaged with the threaded rod; and an abutting part extending from the center part and configured to be abutted against the first restricting member.

In some embodiments, the first restricting member is in form of a pin, and is movable inside the lock body along a direction perpendicular to an extension direction of the lock hole.

In some embodiments, the lock body has two said lock holes respectively formed at opposite sides of a same surface of the lock body, wherein each of the lock holes is configured for plugging and unplugging operations of one said lock lever; wherein one said third detecting element is provided at the bottom of each of the lock holes.

In some embodiments, the intelligent lock may further comprise: a lock lever assembly constituted by a plurality of lock lever pieces with different lengths, wherein the lock lever is one lock lever piece selected from the lock lever assembly.

In some embodiments, the intelligent lock is a child safety lock of a child-mother type safety lock.

Accordingly, the intelligent lock according to the embodiments of the present disclosure has improved safety and reliability and reduces the manufacturing cost by using a mechanically constructed restriction mechanism. Moreover, in the intelligent lock according to the embodiments of the present disclosure, the lock lever is completely independent of the lock body, which overcomes the limitation that the cooperation between the lock rope and the lock body in the traditional lock can only be achieved by a unidirectional plug operation, and improves use flexibility of the lock, facilitates the operation of the lock. In addition, for the intelligent lock according to the embodiments of the present disclosure lock levers that meet different needs can be selected from lock lever pieces with different lengths and/or models and/or shapes, which can be applied to the locking requirements of cargo compartments with different models/sizes. In addition, according to the intelligent lock provided by the embodiment of the present disclosure, a detection device such as a pogopin device as an example may be used to detect whether the insertion operation or extraction operation of the lock lever relative to the lock hole is in place, which can promptly confirm the unlocking/locking state of the intelligent lock, thereby ensuring the safety of the entire intelligent lock, and increasing the reliability and convenience of the entire intelligent lock.

DETAILED DESCRIPTION OF THE EMBODIMENTS

Specific embodiments of the present disclosure will be described in detail below. It should be noted that the embodiments described herein are for illustration only and are not intended to limit the present disclosure. In the following description, in order to provide a thorough understanding of the present disclosure, a large number of specific details are set forth. However, it is obvious to those skilled in the art that it is not necessary to adopt these specific details to implement the present disclosure. In other embodiments, to avoid obscuring the present disclosure, well-known circuits, materials, or methods have not been described in detail.

Throughout the description, reference to "one embodiment", "embodiments", "one example" or "examples" means that a particular feature, structure or characteristic described in connection with the embodiment or example is included in at least one embodiment of the present disclosure. Therefore, the phrases "in one embodiment", "in embodiments", "for an example" or "for example" appeared in various places throughout the description do not necessarily all refer to the same embodiment or example. Furthermore, specific features, structures, or characteristics may be combined in one or more embodiments or examples in any suitable combination and/or sub-combination. In addition, those skilled in the art should understand that the drawings presented herein are for illustrative purposes, and the drawings are not necessarily drawn to scale. The term "and/or" as used herein includes any and all combinations of one or more of the associated listed items.

Throughout the description, the terms named with "first", "second", "third" and so on are used. It should be understood that the terms named by these numbers do not indicate any order of importance, priority, etc., but only intends to describe different parts so that the different parts can be distinguished by different names.

The present disclosure is described in detail below with reference to the drawings.

Figure 1:
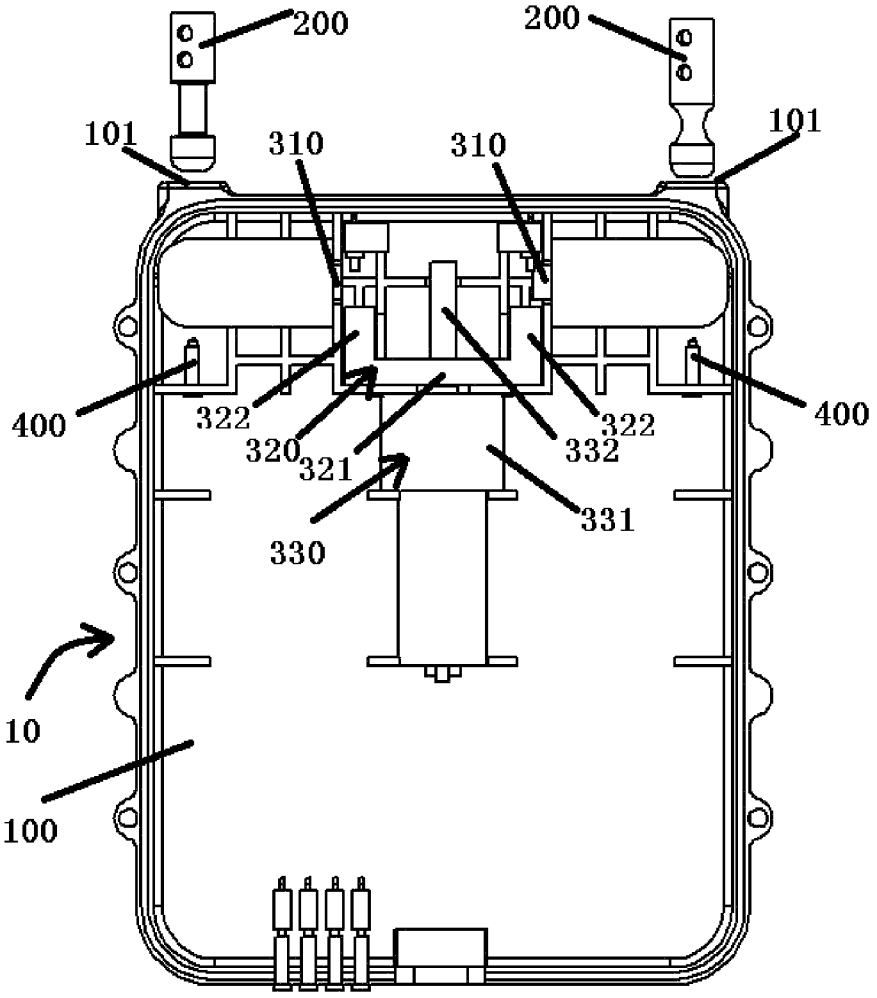
FIG. 1 is a schematic structure diagram of an intelligent lock according to an embodiment of the present disclosure, showing a state in which a lock lever is not plugged into a lock body.
Figure 2:
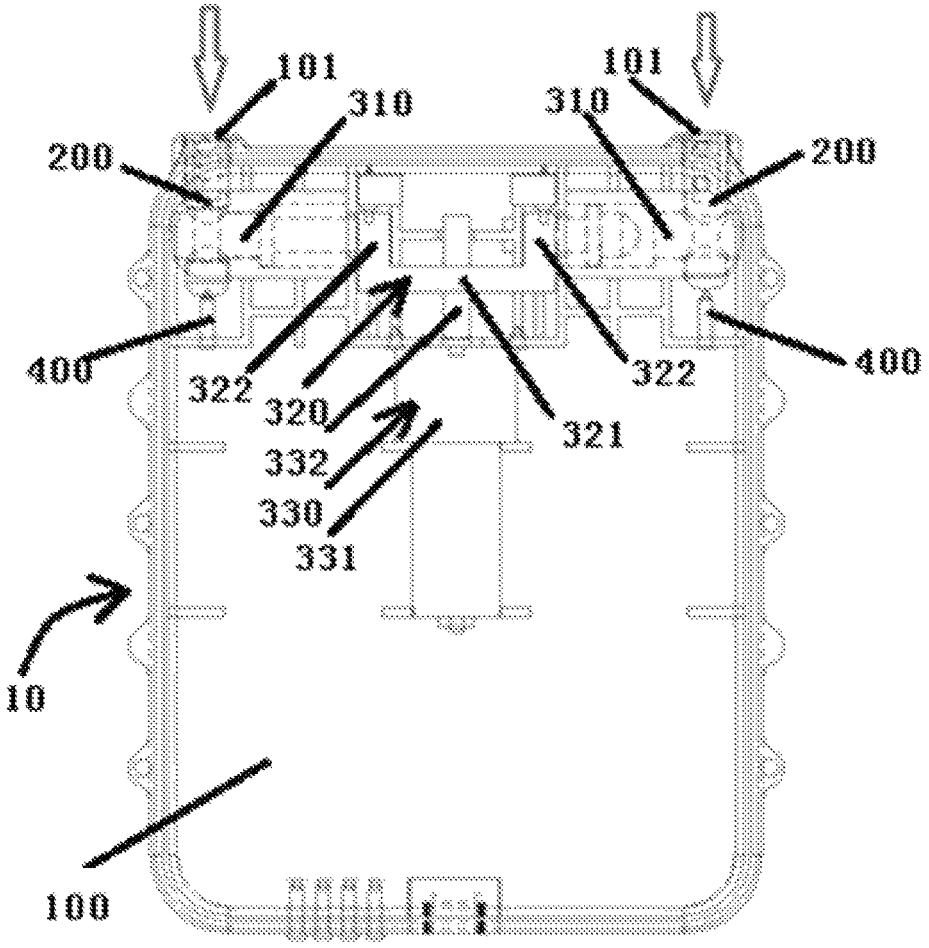
FIG. 2 is a schematic perspective structure diagram of an intelligent lock according to the embodiment of the present disclosure, showing a state in which the lock lever is plugged into the lock body and restricted by a restriction mechanism.

The present disclosure provides an intelligent lock, which is mainly used in the field of logistics supervision, especially for a child safety lock in a child-mother type safety lock in a cargo compartment (e.g., a container). Referring to FIG. 1 and FIG. 2, according to an embodiment of the present disclosure, the intelligent lock 10 includes: a lock body 100 and a lock lever 200 which are capable of unlocking and locking cooperation with each other. The lock body 100 has a lock hole 101. The lock lever 200 is presented independent of the lock body 100. The lock lever 200 can be plugged into and unplugged out of the lock hole 101 of the lock body 100. FIG. 1 shows the intelligent lock according to the embodiment of the present disclosure is in a state in which the lock lever is not plugged into the lock body; FIG. 2 shows the intelligent lock according to the embodiment of the present disclosure is in a state in which the lock lever is plugged into the lock body and restricted by the restriction mechanism. When the lock lever 200 is plugged into the lock hole 101 of the lock body 100, a locked state is formed between the two. When the lock lever 200 is unplugged out of the lock hole 101 of the lock body 100, an unlocked state is formed between the two. At this time, the lock lever 200 can be completely separated from the lock body 100 and exist independently of the lock body 100. According to an embodiment of the present disclosure, the intelligent lock 10 further includes a restriction mechanism, and the restriction mechanism is provided inside the lock body 100. The restriction mechanism is mainly used to restrict a plugging of the lock lever 200 into the lock hole 101 or a unplugging of the lock lever 200 out of the lock hole 101, that is, to restrict the plugging and unplugging operations of the lock lever 200 relative to the lock hole 101, so as to ensure that the intelligent lock can be stably in the locked state, or avoid that the lock lever is plugged into the lock hole of the lock body unintentionally.

According to an embodiment of the present disclosure, as shown in FIG. 1 and FIG. 2, the restriction mechanism includes: a first restricting member 310 and a second restricting member 320. The first restricting member 310 is movably provided inside the lock body 100, and is capable of being moved and latched into the lock hole 101 of the lock body 100 to restrict the plugging of the lock lever 200 into the lock hole 101 or the unplugging of the lock lever 200 out of the lock hole 101. The second restricting member 320 may also be movably provided inside the lock body 100, and is capable of being abutted against the first restricting member 310 so as to restrict a movement of the first restricting member 310. In this way, when the intelligent lock 10 needs to obtain the locked state, the lock lever 200 is plugged into the lock hole 101 of the lock body 100, and then the lock lever 200 can be mechanically restricted in the lock hole 101 of the lock body 100 through the restriction mechanism, thereby ensuring the intelligent lock can be stably in the locked state; when the intelligent lock 10 needs to obtain the unlocked state, the restriction mechanism releases the mechanical restriction on the lock lever 200, so that the lock lever 200 can freely insert into and withdraw from the lock hole 101 of the lock body 100 to obtain the unlocked state; further, if necessary, when the lock lever 200 leaves the lock hole 101 of the lock body 100, the restriction mechanism can be set to the mechanical restriction state again to prevent the lock lever from being unintentionally inserted into the lock hole of the lock body.

In an exemplary embodiment of the present disclosure, as shown in FIG. 1 and FIG. 2, the lock lever 200 has a substantially linear rod shape, and one end (the lower end as shown in figures) thereof has a locking portion. The lock body 100 has the lock hole 101 for receiving the lock lever 200 therein. The first restricting member 310 is movably provided inside the lock body and takes the form of a pin (a limiting pin), and one end of the limiting pin has a corresponding locking portion that is able to be engaged and locked with the locking portion of the lock lever 200. The first restricting member (namely the limiting pin in this embodiment) 310 can move inside the lock body 100 in a direction substantially perpendicular to the extension direction of the lock hole 100, and at least a part (specifically the corresponding locking portion) of the first restricting member (namely the limiting pin in this embodiment) 310 can be moved into the lock hole 101 of the lock body 100 to be latched to the locking portion of the lock lever 200. The second restricting member 320 is movably provided inside the lock body 200 and takes the form of a slider. In the illustrated embodiment, the second restricting member (namely the slider in this embodiment) 320 has a center part 321 and an abutting part 322 that extends from the center part 321. In this embodiment, inside the lock body 100, the second restricting member (namely the slider in this embodiment) 320 can move between a first position and a second position. When at the first position (as shown in FIG. 2), the abutting part 322 of the second restricting member (the slider in this embodiment) 320 abuts against the other end of the first restricting member (namely the limiting pin in this embodiment) 310 opposite to the corresponding locking portion, in order to restrict the movement of the first restricting member. When at the second position (as shown in FIG. 1), the second restricting member (namely the slider in this embodiment) 320 is separated from the first restricting member (namely the limiting pin in this embodiment) 310, so that the restriction on the movement of the first restricting member is released.

In this way, when the intelligent lock 10 needs to obtain the locked state, the lock lever 200 is plugged into the lock hole 101 of the lock body 100, and then the first restricting member 310 (at least its end where the locking portion is located) is moved into the lock hole 100 to be latched to the lock lever 200, and then the second restricting member 320 is moved to the first position (as shown in FIG. 2), so that its abutting part 322 abuts against the other end of the first restricting member 310 to restrict the movement of the first restricting member 310; as a result, the lock lever 200 is mechanically restricted in the lock hole 101 of the lock body 100 through the cooperation between the first restricting member 310 and the second restricting member 320, thereby ensuring that the intelligent lock can be stably held in the locked state; and when the intelligent lock 10 needs to obtain the unlocked state, the second restricting member 320 is moved from the first position (as shown in FIG. 2) to the second position (as shown in FIG. 1), and the abutting part 322 of the second restricting member 320 releases its restriction on the movement of the first restricting member 310, at this time the first restricting member 310 can move freely (i.e. can move out of the lock hole 102), such that the lock lever 200 can freely move into or out of the lock hole 102 of the lock body 100 to obtain the unlocked state. Further, if necessary, after the lock lever 200 moves out of the lock hole 101 of the lock body 100, the second restricting member 320 can be moved from the second position (shown in FIG. 1) to the first position (shown in FIG. 2) again, to restrict the first restricting member 310 (at least its end where the locking portion is located) into the lock hole 100 in order to prevent the lock lever 200 from being plugged into the lock hole 101, thereby preventing the lock lever 200 from being unintentionally plugged into the lock hole 101 of the lock body 100.

In the intelligent lock according to embodiments of the present disclosure, the restriction mechanism may further comprise a driving element 330 provided inside the lock body 100 and configured to drive a movement of the second restricting member 320 inside the lock body 100. For example, the driving element 330 is provided inside the lock body 100 and is capable of driving a movement of the second restricting member 320 inside the lock body 100 between the first position and the second position. As described earlier, when at the first position, the second restricting member 320 abuts against the first restricting member 310, in order to restrict the movement of the first restricting member 310. When at the second position, the second restricting member 320 is separated from the first restricting member 310 so that the restriction on the movement of the first restricting member is released. In an exemplary embodiment of the present disclosure, as shown in FIG. 1 and FIG. 2, the driving element may comprise: a driving motor 331, and a threaded rod 332 configured to be driven by the driving motor 331. The threaded rod 332 and the second restricting member (e.g., the slider in the illustrated embodiment) 320 constitute a threaded drive. More specifically, the threaded rod 332 and the center part 321 of the second restricting member 320 cooperate with each other, to constitute the threaded drive. In addition, in a further embodiment, a guide disk may be provided between the threaded rod 332 and the center part 321 of the second restricting member 320 to ensure that the mentioned threaded drive can effectively drive the movement of the second restricting member 320 between the first position and the second position.

Of course, in other embodiments of the present disclosure, the restriction mechanism may also adopt any components and/or structures other than the components and/or structures described in the above exemplary embodiments, as long as the lock lever 200 can act a movement restriction on the plugging and unplugging operations of the lock lever 200 relative to the lock hole 101. For one example, the first restricting member 310 can move obliquely to the extension direction of the lock hole 100 (instead of in a direction substantially perpendicular to the extension direction of the lock hole 100), as long as it can plug into the lock hole 101 of the lock body 100 to play a restriction role. For another example, the movement of the second restricting member 320 may not be driven by the driving motor, but may be driven by another mechanism.

According to embodiments of the present disclosure, as shown in FIG. 1 and FIG. 2, the intelligent lock may further comprise a detecting device. As shown in figures, the detecting device 400 is provided in the lock body 100 and is configured to detect the plugging of the lock lever 200 into the lock hole 101 or the unplugging of the lock lever 200 out of the lock hole 101. Further, the detecting device 400 may send the detection result to the external through communication means, so as to realize the supervision of the intelligent lock 10 by the external, and improve the safety and reliability of the intelligent lock 10.

Figure 3:
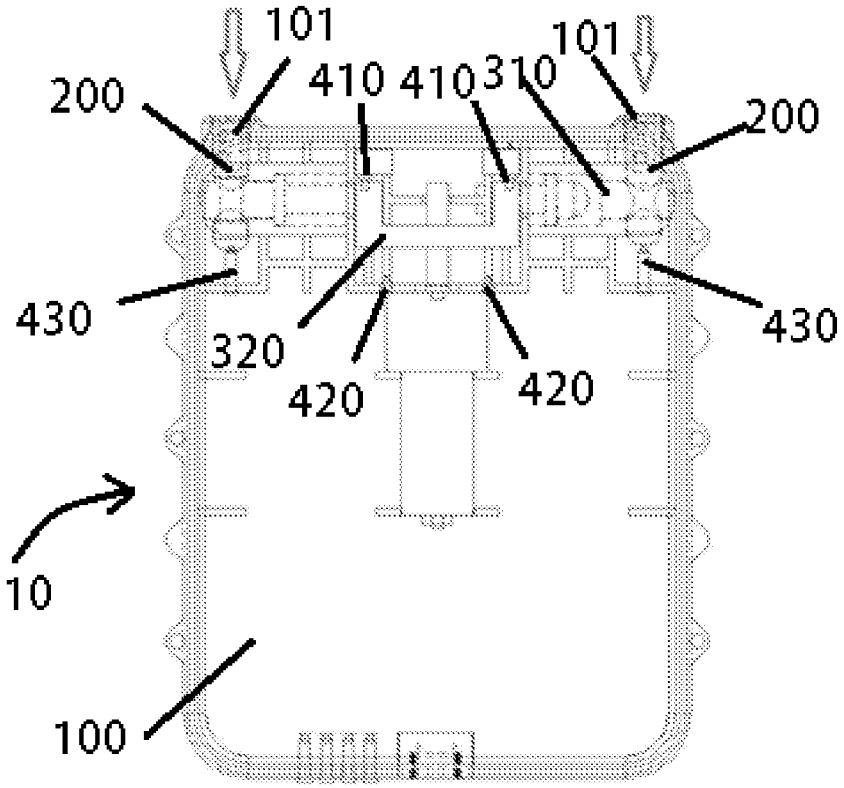
FIG. 3 is a schematic perspective structure diagram of an intelligent lock according to the embodiment of the present disclosure, mainly showing the cooperation between a detecting device and other components.
Figure 4:
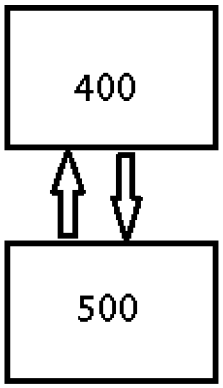
FIG. 4 is a communication block diagram of the detecting device and a main control element in the intelligent lock according to the embodiment of the present disclosure.

A security detecting mechanism in the intelligent lock 10 according to an embodiment of the present disclosure will be described in detail below with reference to FIGS. 2 to 4. As shown in FIGS. 2 to 4, the intelligent lock 10 includes a detecting device 400 and a main control element 500. The detecting device 400 is provided in the lock body 100 for detecting the plugging of the lock lever 200 into the lock hole 101 or the unplugging of the lock lever 200 out of the lock hole 101 and sending a detection signal. The main control element 500 is communicatively connected to the detecting device 400, and is configured to determine a locking state of the intelligent lock 10 in accordance with the detection signal sent by the detecting device 400. Here, FIG. 2 simply illustrates a detection position of the detecting device 400 (taking the third detecting element 430 as an example, which will be described in detail hereinafter) in the lock body 100, and FIG. 3 specifically illustrates specific detection positions of the detecting elements in the detecting device 400 as well as cooperation between the detecting elements and other components in the intelligent lock 10. In addition, FIG. 4 illustrates that the detecting device 400 and the main control element 500 communicate with each other.

Specifically, as shown in FIG. 3, the detecting device may comprise: a first detecting element 410 provided at the first position of the second restricting member 320 and a second detecting element 420 provided at the second position of the second restricting member 320. In the arrangement shown in FIG. 3, the first detecting element 410 is provided at the top of the space where the second restriction member 320 is movable in the lock body, and the second detection device 420 is provided at the bottom of the space where the second restriction member 320 is movable in the lock body.

When the second restricting member 320 is moved to the first position and is in contact with the first detecting element 410 (as shown in FIG. 3), the first detecting element 410 detects the second restricting member 320 and sends a detecting signal to the main control element 500 (see FIG. 4), the main control element determines that the intelligent lock 100 is in an occluded state where the plugging of the lock lever 200 into the lock hole 101 or the unplugging of the lock lever 200 out of the lock hole 101 is defeated, in accordance with the detection signal sent by the first detecting element 410. When the second restricting member 320 is moved to the second position and is in contact with the second detecting element 420, the second detecting element 420 detects the second restricting member 320 and sends a detecting signal to the main control element 500, the main control element determines that the intelligent lock is in an un-occluded state where the plugging of the lock lever 200 into the lock hole 101 or the unplugging of the lock lever 200 out of the lock hole 101 is free or allowable, in accordance with the detection signal sent by the second detecting element 420.

Further, as shown in FIG. 3, the detecting device may further comprise: a third detecting element 430 provided at a bottom of the lock hole 101. When the lock lever 200 is plugged into the lock hole 101, the lock lever 200 is in contact with the third detecting element 430, the third detecting element 430 detects the plugging of the lock lever 200 and sends a detecting signal to the main control element, and the main control element determines that the lock lever is in a plugged state in accordance with the detection signal sent by the third detecting element 430.

Furthermore, when the intelligent lock 10 is in the occluded state, the main control element determines that the intelligent lock 10 is in an abnormal condition (such as being accidentally unlocked or destroyed) if the detection signal sent by any one of the first detecting element 410 and the third detecting element 430 disappears. In this case, the main control element can cooperate with other security detecting mechanisms of the intelligent lock 10 (or even of the entire logistics cargo compartment) to provide security detection warnings for the intelligent lock (or even for the entire logistics cargo compartment).

According to embodiments of the present disclosure, the second restricting member 320 may be made of a metal material, and the first detecting element 410, the second detecting element 420, and the third detecting element 430 may adopts spring-loaded post rods, such as a pogo pin. It can be seen that, in the embodiments of the present disclosure, the spring post rod with small-volume and low-cost (taking a pogo pin as an example) is adopted as an auxiliary device for safety detection, so that under the premise of ensuring the safety of the entire intelligent lock, it improves reliability and convenience of the entire intelligent lock, and reduces the manufacturing cost, when compared with auxiliary devices such as a travel switch or a Hall device used in the prior art.

According to embodiments of the present disclosure, in the intelligent lock 10 as shown in FIG. 1 and FIG. 2, the lock body 100 has two lock holes 101 respectively formed at opposite sides of a same surface (the upper surface in the embodiment as shown in figures) of the lock body 100, wherein each of the lock holes 101 is configured for plugging and unplugging operations of one lock lever 200. In addition, as shown in FIG. 3, one third detecting element 430 is provided at the bottom of each of the lock holes 101.

Furthermore, in some embodiments of the present disclosure, the intelligent lock may further comprise a lock lever assembly constituted by a plurality of lock lever pieces. The plurality of lock lever pieces in the lock lever assembly may have different lengths and/or models and/or shapes. The lock lever 200 described in the forgoing embodiments can be one lock lever piece with certain length and/or model and/or shape, selected from the lock lever assembly. In this way, the intelligent lock 10 according to the present disclosure can provide different lock lever pieces according to different requirements to meet the diverse requirements of the intelligent lock 10. In addition, in some other embodiments of the present disclosure, the intelligent lock 10 can also use a lock rope to replace the lock lever described above, as long as the restriction function of the restriction mechanism in the intelligent lock 10 can also be applied to the unlocking and locking states of the lock rope.

Accordingly, the intelligent lock according to the embodiments of the present disclosure has improved safety and reliability and reduces the manufacturing cost by using a mechanically constructed restriction mechanism. Moreover, in the intelligent lock according to the embodiments of the present disclosure, the lock lever is completely independent of the lock body, which overcomes the limitation that the cooperation between the lock rope and the lock body in the traditional lock can only be achieved by a unidirectional plug operation, and improves use flexibility of the lock, facilitates the operation of the lock. In addition, the intelligent lock according to the embodiments of the present disclosure can select lock levers that meet different needs from lock lever pieces with different lengths and/or models and/or shapes, which can be applied to the locking requirements of cargo compartments with different models/sizes.

However, it should be understood that, in order to highlight the key points in the embodiments of the present disclosure, some details have been omitted in the above description. However, these and/or those technical details may also be included in the embodiments of the present disclosure.

Although the present disclosure has been described with reference to several embodiments, it should be understood that the terms used are illustrative and exemplary rather than restrictive. Since the present disclosure can be embodied in various forms without departing from the spirit or essence of the present disclosure, it should be understood that the above embodiments are not limited to any of the foregoing details, but should be widely interpreted within the spirit and scope defined by the appended claims. Therefore, all changes and modifications falling within the scope of the claims or their equivalents should be covered by the appended claims.

What is claimed is:

1. An intelligent lock comprising:

a lock body having a lock hole;

a lock lever, wherein the lock lever is independent of the lock body, and the lock lever is capable of being plugged into and being completely separated from the lock hole of the lock body;

a first restricting member movably provided inside the lock body, and capable of being moved and latched into the lock hole to restrict the plugging of the lock lever into the lock hole or the unplugging of the lock lever out of the lock hole;

a second restricting member movably provided inside the lock body, and capable of being abutted against the first restricting member so as to restrict a movement of the first restricting member;

a detecting device provided in the lock body, and configured to detect the plugging operation of the lock lever into the lock hole or the unplugging operation of the lock lever out of the lock hole and to send a detection signal; and a main control element communicatively connected to the detecting device, and configured to determine a locking state of the intelligent lock in accordance with the detection signal sent by the detecting device;

wherein the second restricting member is movable inside the lock body, between a first position in which the second restricting member is abutted against the first restricting member and a second position in which the second restricting member is separated from the first restricting member; and the detecting device comprises: a first detecting element provided at the first position and a second detecting element provided at the second position; and wherein the main control element is configured: in response to the second restricting member being moved to be in contact with the first detecting element, to determine, in accordance with the detection signal sent by the first detecting element, that the intelligent lock is in an occluded state where the plugging of the lock lever into the lock hole or the unplugging of the lock lever out of the lock hole is defeated; and in response to the second restricting member being moved to be in contact with the second detecting element, to determine, in accordance with the detection signal sent by the second detecting element, that the intelligent lock is in an un-occluded state where the plugging of the lock lever into the lock hole or the unplugging of the lock lever out of the lock hole is freely enabled.

2. The intelligent lock of claim 1, wherein the detecting device further comprises:

a third detecting element provided at a bottom of the lock hole;

wherein, in response to the lock lever being plugged into the lock hole, the lock lever is in contact with the third detecting element, and the main control element determines that the lock lever is in a plugged state in accordance with the detection signal sent by the third detecting element.

3. The intelligent lock of claim 2, wherein in the occluded state of the intelligent lock, the main control element determines that the intelligent lock is in an abnormal condition if no detection signal is sent by any one of the first detecting element and the third detecting element.

4. The intelligent lock of claim 2, wherein the first detecting element, the second detecting element, and the third detecting element are spring-loaded post rods.

5. The intelligent lock of claim 1, further comprising: a driving element provided inside the lock body, and configured to drive a movement of the second restricting member inside the lock body, between the first position and the second position;

wherein the driving element comprises:

a driving motor; and a threaded rod configured to be driven by the driving motor, the threaded rod and the second restricting member constituting a threaded drive.

6. The intelligent lock of claim 5, wherein the second restricting member has: a center part configured to be engaged with the threaded rod; and an abutting part extending from the center part and configured to be abutted against the first restricting member.

7. The intelligent lock of claim 5, wherein the first restricting member is in form of a pin, and is movable inside the lock body along a direction perpendicular to an extension direction of the lock hole.

8. The intelligent lock of claim 2, wherein the lock body has two said lock holes respectively formed at opposite sides of a same surface of the lock body, wherein each of the lock holes is configured for plugging and unplugging operations of one said lock lever; wherein one said third detecting element is provided at the bottom of each of the lock holes.

9. The intelligent lock of claim 1, wherein the lock lever is one lock lever piece selected from a plurality of lock lever pieces with different lengths.

* * * * *